US011529811B2

(12) United States Patent
Nakamura et al.

(10) Patent No.: US 11,529,811 B2
(45) Date of Patent: Dec. 20, 2022

(54) LIQUID EJECTING APPARATUS

(71) Applicant: SEIKO EPSON CORPORATION, Tokyo (JP)

(72) Inventors: Hiroyuki Nakamura, Shiojiri (JP); Masaru Kobashi, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 69 days.

(21) Appl. No.: 17/111,772

(22) Filed: Dec. 4, 2020

(65) Prior Publication Data

US 2021/0170756 A1 Jun. 10, 2021

(30) Foreign Application Priority Data

Dec. 5, 2019 (JP) ..... JP2019-220240

(51) Int. Cl.
*B41J 2/175* (2006.01)
*B41J 2/185* (2006.01)

(52) U.S. Cl.
CPC ..... *B41J 2/17523* (2013.01); *B41J 2/185* (2013.01)

(58) Field of Classification Search
CPC ..... B41J 2/17523; B41J 2/185; B41J 2/1752; B41J 2/1753; B41J 2/17546; B41J 2/17553; B41J 2/17513
USPC ..... 347/85
See application file for complete search history.

(56) References Cited

U.S. PATENT DOCUMENTS 4,878,069 A * 10/1989 Kiyohara ..... B41J 2/175 347/22
5,448,274 A * 9/1995 Hirabayashi ..... B41J 2/17526 347/50
2004/0113974 A1* 6/2004 Shimamura ..... B41J 2/17566 347/36
2011/0181671 A1* 7/2011 Ishibe ..... B41J 2/17566 222/548

FOREIGN PATENT DOCUMENTS

| | | | |
|---|---|---|---|
| JP | 2006044154 | A | 2/2006 |
| JP | 2010132006 | A | 6/2010 |
| JP | 2010253963 | A | 11/2010 |
| JP | 2012111240 | A | 6/2012 |
| JP | 2012183839 | A | 9/2012 |

* cited by examiner

*Primary Examiner* — Kristal Feggins
*Assistant Examiner* — Alexander D Shenderov
(74) *Attorney, Agent, or Firm* — Chip Law Group

(57) ABSTRACT

A liquid ejecting apparatus includes a liquid ejecting head that ejects liquid and an attachment portion to which a liquid container that stores the liquid supplied to the liquid ejecting head is detachably attached. The attachment portion includes a liquid inlet portion that is coupled to a liquid outlet provided in the liquid container, and an urging mechanism that urges the liquid container in a direction opposite to an attaching direction in which the liquid container is attached to the attachment portion. The urging mechanism includes an elastic member that is in close contact with the liquid container attached to the attachment portion and that is provided below the liquid inlet portion in a direction of gravity.

9 Claims, 9 Drawing Sheets

LIQUID EJECTING APPARATUS

The present application is based on, and claims priority from JP Application Serial Number 2019-220240, filed Dec. 5, 2019, the disclosure of which is hereby incorporated by reference herein in its entirety.

BACKGROUND

1. Technical Field

The present disclosure relates to a liquid ejecting apparatus that includes a liquid ejecting head which ejects liquid and an attachment portion to which a liquid container that stores the liquid supplied to the liquid ejecting head is detachably attached.

2. Related Art

A liquid ejecting apparatus that includes a liquid ejecting head configured to eject liquid and an attachment portion to which a liquid container that stores the liquid supplied to the liquid ejecting head is detachably attached has been known. The attachment portion has a liquid inlet portion that is coupled to a liquid outlet provided in the liquid container, and an urging mechanism that urges the liquid container in a direction opposite to a direction of attaching the liquid container to the attachment portion. In such a liquid ejecting apparatus, the liquid may leak from a portion at which the liquid outlet and the liquid inlet portion are coupled.

On the other hand, according to JP-A-2010-132006, an absorbing member is stored in an urging mechanism and a part of the absorbing member protrudes from the urging mechanism toward a liquid container, and thereby, in a state where the liquid container is attached to an attachment portion, the part of the absorbing member which protrudes from the urging mechanism is in contact with a surface of the liquid container, on which a liquid outlet is formed. As a result, even when liquid leaks from a portion at which the liquid outlet and a liquid inlet portion are coupled, the leaked liquid is absorbed by the absorbing member.

However, when the amount of the liquid that leaks from the portion at which the liquid outlet and the liquid inlet portion are coupled exceeds the amount of liquid that is able to be absorbed by the absorbing member, the liquid overflows from the absorbing member and flows along an outer surface of the liquid container, and therefore, the outer surface of the liquid container may be widely soiled. Soiling of the outer surface of the liquid container may result in the hand of a user being soiled when the user exchanges the liquid container.

SUMMARY

In order to solve the aforementioned problem, a liquid ejecting apparatus includes: a liquid ejecting head that ejects liquid; and an attachment portion to which a liquid container that stores the liquid supplied to the liquid ejecting head is detachably attached, in which the attachment portion includes a liquid inlet portion that is coupled to a liquid outlet provided in the liquid container, and an urging mechanism that urges the liquid container in a direction opposite to an attaching direction in which the liquid container is attached to the attachment portion, and the urging mechanism includes an elastic member that is in close contact with the liquid container attached to the attachment portion and that is provided below the liquid inlet portion in a direction of gravity.

DESCRIPTION OF EXEMPLARY EMBODIMENTS

An embodiment of a liquid ejecting apparatus will be described below with reference to the drawings. The X-axis, Y-axis, and Z-axis illustrated in FIG. 1 denote three spatial axes orthogonal to each other. Note that the X-axis, Y-axis, and Z-axis in the other drawings correspond respectively to the X-axis, Y-axis, and Z-axis in FIG. 1. The liquid ejecting apparatus is installed on a horizontal plane having an X direction which is a direction extending along the X-axis and a Y direction which is a direction extending along the Y-axis. The X direction is a direction in which a liquid container (described later) is attached to or detached from an attachment portion (described later) of the liquid ejecting apparatus. A direction in which the liquid container is attached to the attachment portion is defined as a +X direction and a direction in which the liquid container is detached from the attachment portion is defined as a −X direction. In other words, the +X direction is a direction extending from the liquid container to the attachment portion. In a direction extending along the Z-axis, the direction of gravity is defined as a −Z direction and a direction opposite to the direction of gravity is defined as a +Z direction.

Figure 1:
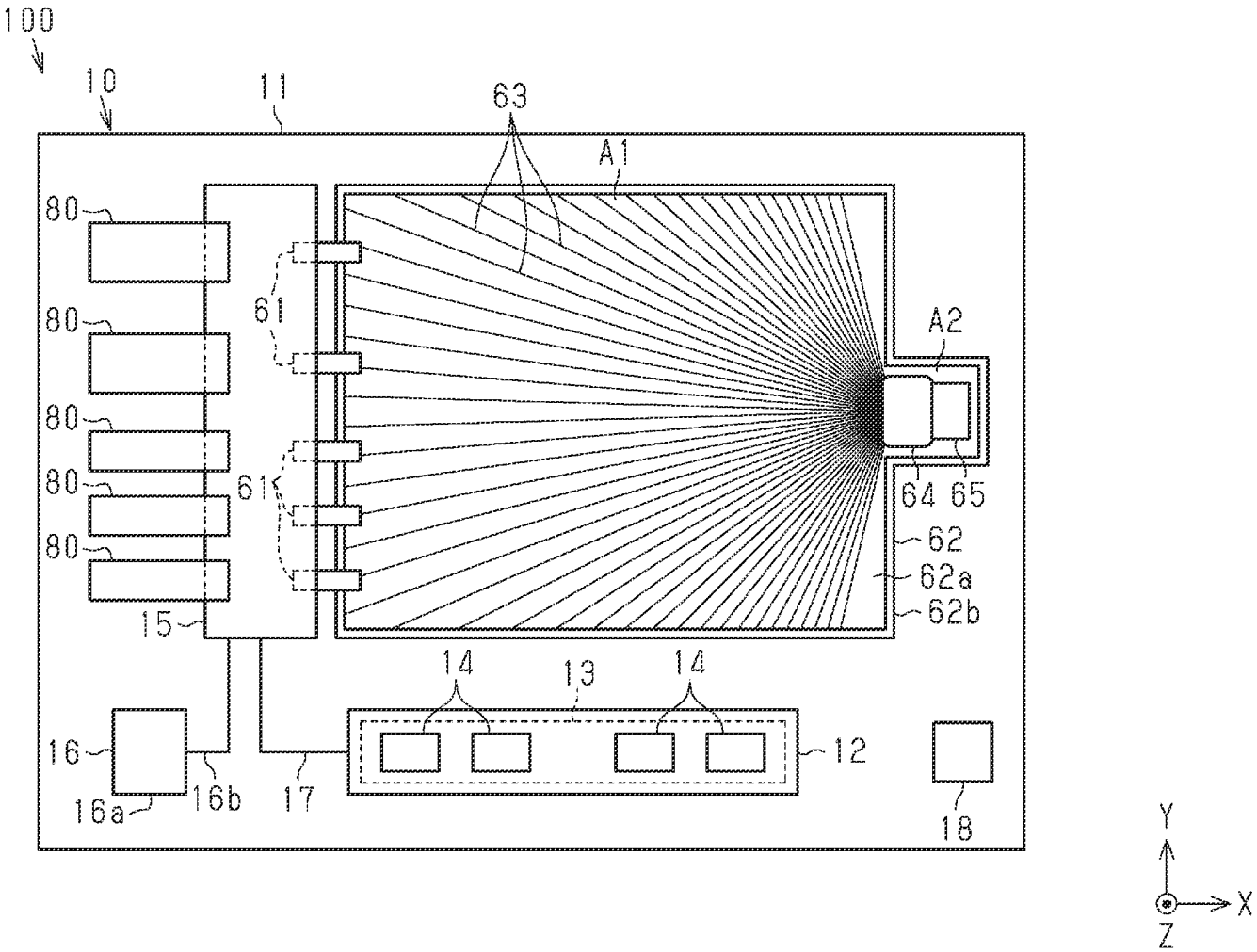
FIG. 1 is a schematic view of a liquid ejecting system.

As illustrated in FIG. 1, a liquid ejecting system 100 includes a liquid ejecting apparatus 10 and a liquid container 80 that is attached to the liquid ejecting apparatus 10. The liquid ejecting apparatus 10 is an ink jet printer that ejects ink, which is an example of a liquid, onto a medium such as a sheet and thereby prints characters, images, or the like on the medium. The liquid container 80 is a cartridge that stores liquid supplied to the liquid ejecting apparatus 10. A plurality of liquid containers 80 that store inks having properties different from each other, for example, inks having different colors, are attached to the liquid ejecting apparatus 10. For example, one liquid container 80 corresponding to cyan, one liquid container 80 corresponding to magenta, one liquid container 80 corresponding to yellow, and two liquid containers 80 corresponding to black are attached to the liquid ejecting apparatus 10 of the present embodiment.

The liquid ejecting apparatus 10 includes a housing 11 in a box shape and a head holding portion 12 stored in the housing 11. The head holding portion 12 has a liquid ejecting head 13 and a valve unit 14. The liquid ejecting head 13 ejects liquid onto the medium. The valve unit 14 causes accumulation of the liquid ejected from the liquid ejecting head 13. The liquid ejecting apparatus 10 of the present embodiment has four valve units 14 corresponding to cyan, magenta, yellow, and black.

The liquid ejecting head 13 may be a line head or a serial head. When the liquid ejecting head 13 is a line head, a plurality of nozzles, which are arranged in a range substantially the same as the medium width, eject a plurality of liquid droplets simultaneously onto the medium that is transported at a constant speed. Alternatively, when the liquid ejecting head 13 is a serial head that performs scanning of the medium, the head holding portion 12 is a carriage that moves in a scanning direction. While the carriage moves in the scanning direction, the liquid ejecting head 13 ejects liquid droplets onto the medium by using nozzles. When a serial recording type liquid ejecting apparatus is used, a recording operation for a single scan in which liquid droplets are ejected while the liquid ejecting head 13 moves and a transportation operation in which the medium is transported to the next recording position are alternately performed.

The liquid ejecting apparatus 10 includes an attachment portion 15, a pressurizing mechanism 16, and a coupling channel 17. The attachment portion 15, the pressurizing mechanism 16, and the coupling channel 17 are stored in the housing 11. The liquid containers 80 are detachably attached to the attachment portion 15. The pressurizing mechanism 16 is able to supply a corresponding pressurized fluid to the plurality of liquid containers 80 attached to the attachment portion 15. The pressurizing mechanism 16 has a pump 16*a*, a pressurized fluid channel 16*b*, and a pressurizing portion 24 described later. The coupling channel 17 couples the attachment portion 15 and the liquid ejecting head 13. Specifically, the coupling channel 17 separately couples liquid inlet portions 30 (refer to FIG. 2) described later, which are included in the attachment portion 15, and the valve units 14 each of which causes accumulation of liquid having the same color as the liquid introduced into a corresponding one of the liquid inlet portions 30.

The liquid ejecting apparatus 10 has a control portion 18 that integrally controls the liquid ejecting apparatus 10. The control portion 18 is constituted by, for example, a processing circuit that includes a computer and memory. The control portion 18 controls operation of the liquid ejecting head 13, the pressurizing mechanism 16, and the like in accordance with a program stored in the memory. The control portion 18 controls operation of the pressurizing mechanism 16 and thereby controls supply of the pressurized fluid to each of the liquid containers 80.

Next, the attachment portion 15 will be described in detail with reference to FIGS. 2 to 4.

Figure 2:
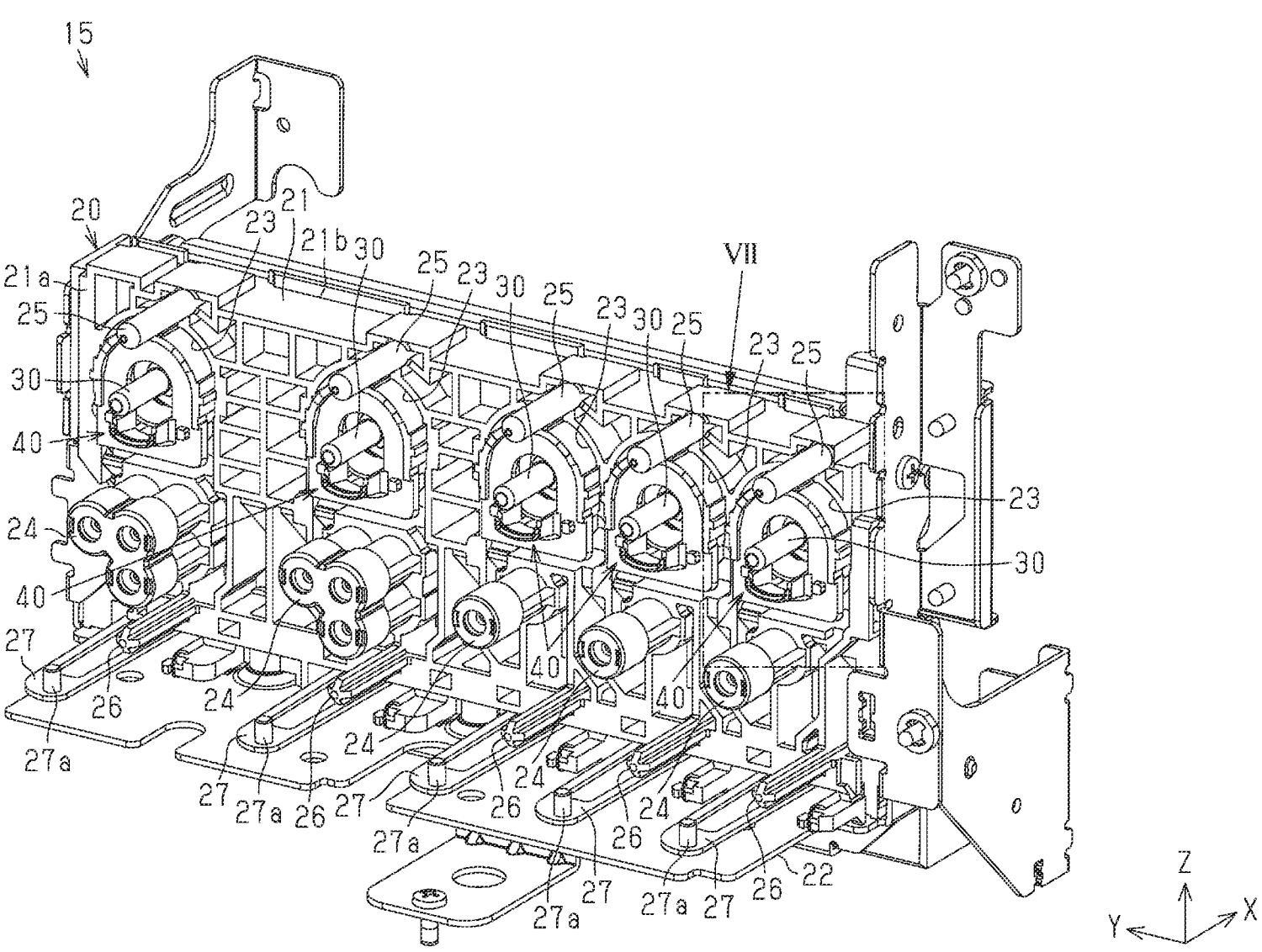
FIG. 2 is a perspective view of an attachment portion.

As illustrated in FIG. 2, the attachment portion 15 includes a support member 20. The support member 20 has a first support portion 21 and a second support portion 22. The first support portion 21 is a wall that extends in the Y direction and the Z direction. The first support portion 21 has a longitudinal direction in the Y direction and the first support portion 21 has a transverse direction in the Z direction. The second support portion 22 is a wall that extends in the X direction and the Y direction. The second support portion 22 has a longitudinal direction in the Y direction and the second support portion 22 has a transverse direction in the X direction.

Figure 3:
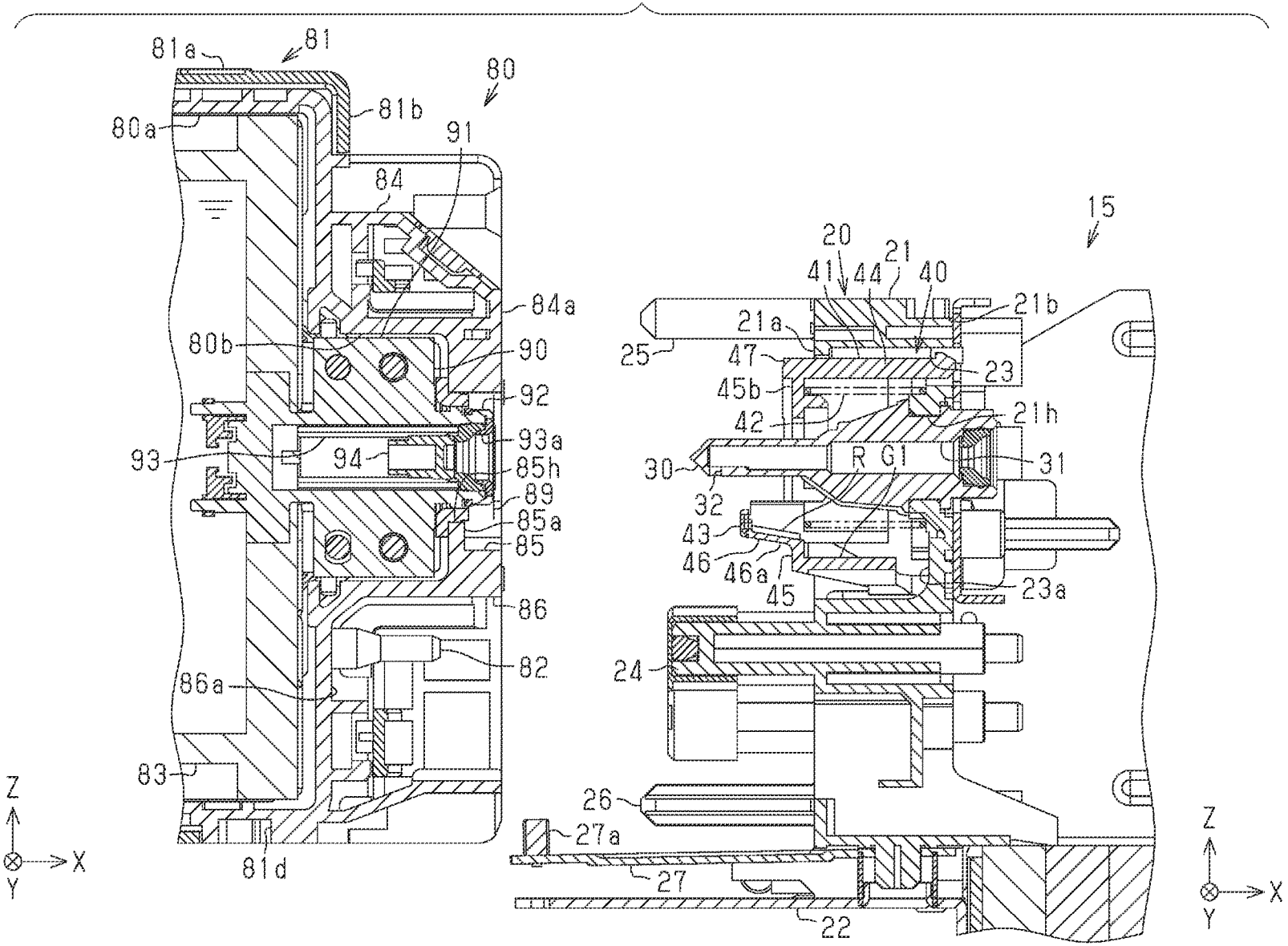
FIG. 3 is a portional view of the attachment portion and a liquid container before the liquid container is attached.
Figure 4:
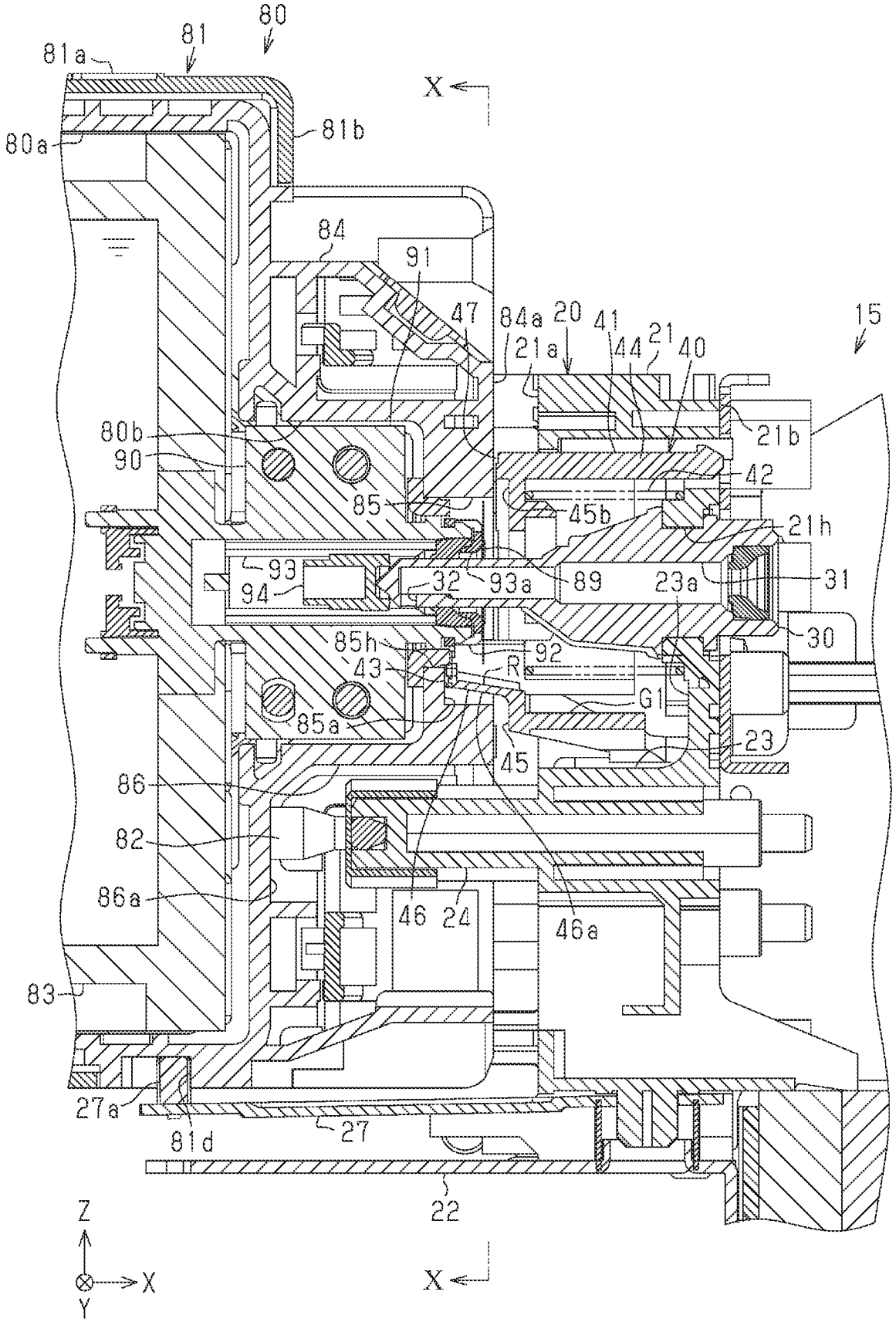
FIG. 4 is a portional view of the attachment portion and the liquid container after the liquid container is attached.

As illustrated in FIGS. 3 and 4, of the two surfaces of the first support portion 21 in the X direction, a surface positioned in the −X direction is defined as an attachment surface 21*a* and a surface positioned in the +X direction is defined as a non-attachment surface 21*b*. In the first support portion 21, a storage recess 23 that is recessed from the attachment surface 21*a* in the +X direction is formed. As illustrated in FIG. 2, in the first support portion 21 of the present embodiment, five storage recesses 23 are formed side by side in the Y direction. As illustrated in FIGS. 3 and 4, a first insertion hole 21*h* that passes through the first support portion 21 in the X direction is formed in a bottom surface 23*a* of each of the storage recesses 23.

The attachment portion 15 includes the pressurizing portion 24. The attachment portion 15 of the present embodiment includes five pressurizing portions 24 arranged side by side in the Y direction. As described above, the pressurizing portions 24 form a part of the pressurizing mechanism 16 and supply the pressurized fluid to the liquid containers 80. Each of the pressurizing portions 24 has a cylindrical member whose axis extends in the X direction. A −X-direction end of the pressurizing portion 24 protrudes more than the attachment surface 21*a* of the first support portion 21 in the −X direction. Each of the pressurizing portions 24 is positioned in the −Z direction with respect to each of the storage recesses 23.

The attachment portion 15 includes a first positioning protrusion 25 and a second positioning protrusion 26. The attachment portion 15 of the present embodiment includes five first positioning protrusions 25 arranged side by side in the Y direction and five second positioning protrusions 26 arranged side by side in the Y direction. The first positioning protrusions 25 and the second positioning protrusions 26 determine positions of the liquid containers 80 in the Y direction and the Z direction with respect to the attachment portion 15. The first positioning protrusions 25 and the second positioning protrusions 26 are each members having a bar shape and protruding from the attachment surface 21*a* of the first support portion 21 in the −X direction. The respective first positioning protrusions 25 are positioned in the +Z direction with respect to the respective storage recesses 23. The respective second positioning protrusions 26 are positioned in the −Z direction with respect to the respective pressurizing portions 24.

The attachment portion 15 includes a regulating portion 27. The attachment portion 15 of the present embodiment includes five regulating portions 27 arranged side by side in the Y direction. Each of the regulating portions 27 regulates movement of a corresponding one of the liquid containers 80 in the −X direction in a state where the liquid container 80 is attached to the attachment portion 15. The regulating portion 27 is a plate that has a rectangular shape and that extends in the X direction and the Y direction. The regulating portion 27 has a longitudinal direction in the X direction. As illustrated in FIG. 3, a +X-direction end of the regulating portion 27 is attached to a −Z-direction end surface of the first support portion 21. A large portion of the regulating portion 27 in the longitudinal direction protrudes more than the attachment surface 21*a* of the first support portion 21 in the −X direction. The portion of the regulating portion 27, which protrudes more than the attachment surface 21*a* of the first support portion 21, is elastically deformable in the −Z direction. The regulating portion 27 has, in a −X-direction end, a pin 27*a* that protrudes in the +Z direction.

The attachment portion 15 includes the liquid inlet portion 30. The attachment portion 15 of the present embodiment includes five liquid inlet portions 30. Each of the liquid inlet portions 30 is coupled to a liquid outlet 93*a* (refer to FIGS. 3 and 4) described later, which is provided in the liquid container 80. The liquid inlet portion 30 is a cylindrical member whose axis extends in the X direction. By inserting the liquid inlet portion 30 into the first insertion hole 21*h* of the first support portion 21, the liquid inlet portion 30 is mounted on the support member 20. Thus, the five liquid inlet portions 30 are arranged side by side in the Y direction. In a state where each of the liquid inlet portions 30 is mounted on the support member 20, a −X-direction end of the liquid inlet portion 30 protrudes more than the attachment surface 21*a* of the first support portion 21 in the −X direction and a +X-direction end of the liquid inlet portion 30 protrudes more than the non-attachment surface 21*b* of the first support portion 21 in the +X direction. The −X-direction end of the liquid inlet portion 30 has a tapered shape. The liquid inlet portion 30 interior serves as an inlet channel 31 into which liquid is introduced. In the −X-direction end of the liquid inlet portion 30, a communication hole 32 by which the inlet channel 31 and the outside of the liquid inlet portion 30 communicate with each other is formed.

The attachment portion 15 has an urging mechanism 40. The urging mechanism 40 urges the liquid container 80 in the −X direction. In other words, the urging mechanism 40 urges the liquid container 80 in a direction opposite to a direction of attaching the liquid container 80 to the attachment portion 15. The urging mechanism 40 has a pressing member 41, an urging member 42, and an elastic member 43. The urging member 42 of the present embodiment is a coil spring. The elastic member 43 of the present embodiment is formed of an elastomer. The pressing member 41 and the elastic member 43 are formed by two-color molding. The pressing member 41 and the elastic member 43 are integrated.

Figure 5:
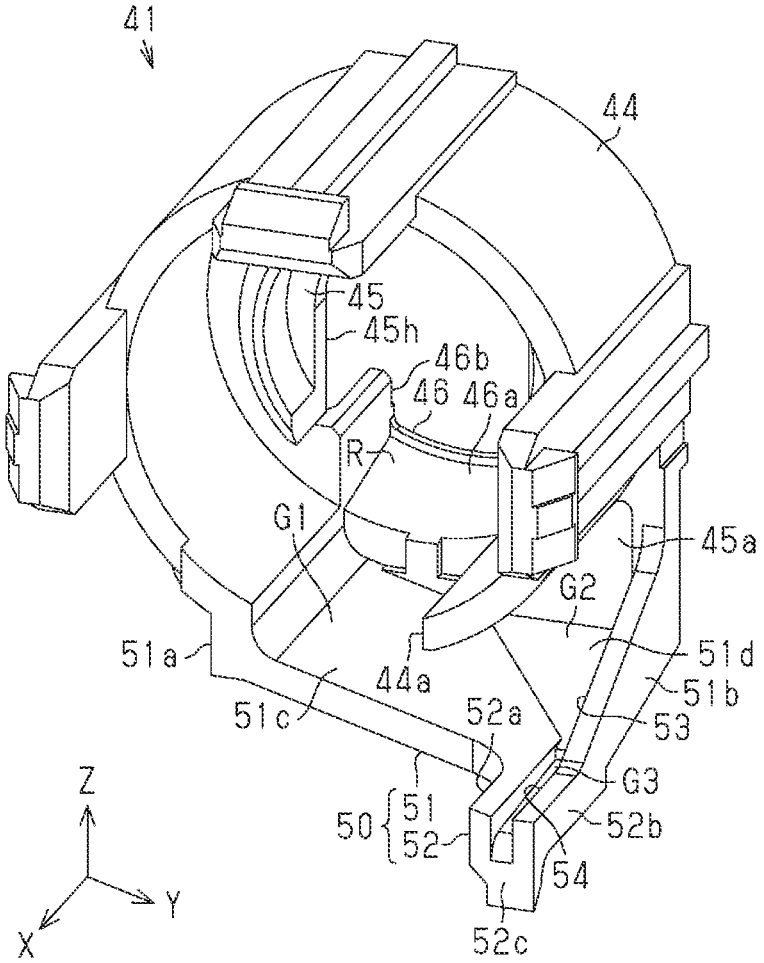
FIG. 5 is a perspective view of a pressing member.
Figure 6:
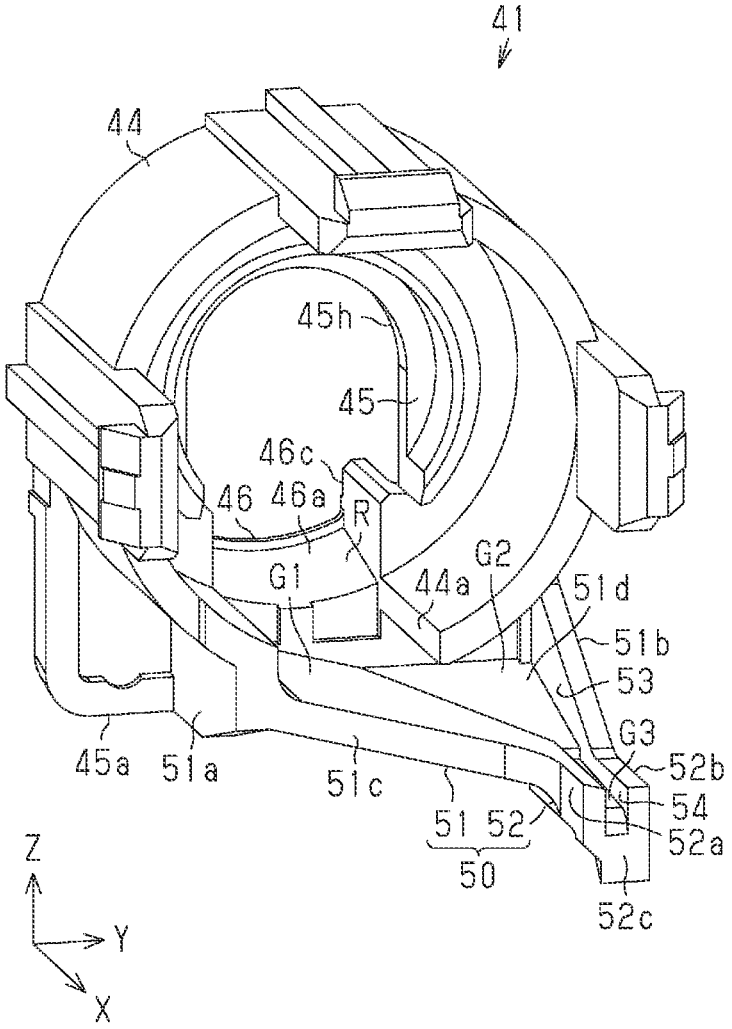
FIG. 6 is a perspective view of the pressing member.

As illustrated in FIGS. 5 and 6, the pressing member 41 has a cover portion 44 and a pressing portion 45. The cover portion 44 has a substantially cylindrical shape whose axis extends in the X direction. The cover portion 44 has a discontinuous portion 44*a* a part of which is broken in a peripheral direction. The discontinuous portion 44*a* is positioned in the −Z direction in the cover portion 44. The pressing portion 45 is a member that has a plate shape and that is continuous to a −X-direction end of the cover portion 44. In the pressing portion 45, a second insertion hole 45*h* that passes through the pressing portion 45 in the X direction is formed. The pressing portion 45 includes an main wall 45*a* that extends in the −Z direction.

Figure 7:
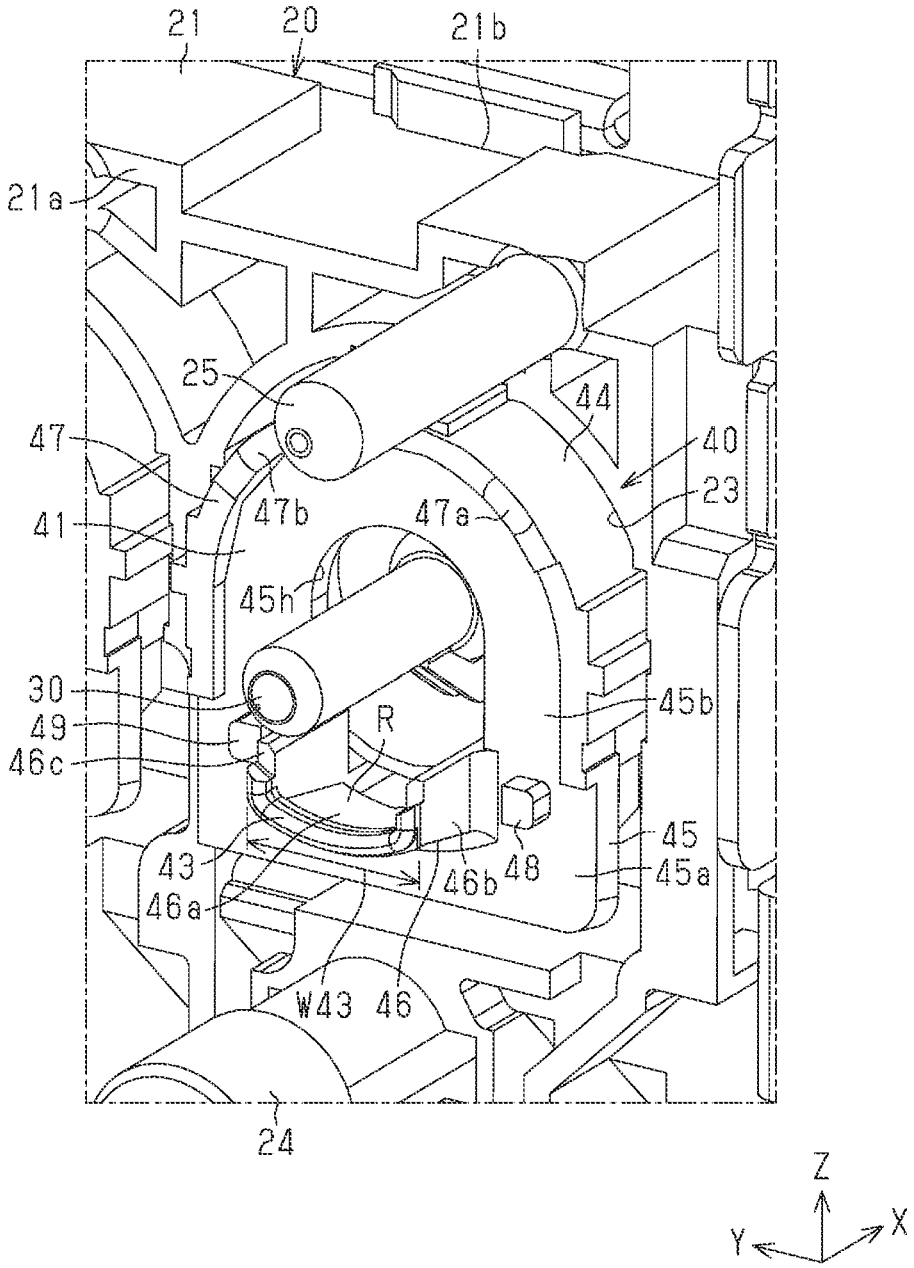
FIG. 7 is an enlarged view of a portion surrounded by a one-dot chain line in FIG. 2

As illustrated in FIG. 7, the pressing member 41 has a receiving portion 46. The receiving portion 46 is a portion that receives liquid which leaks from a portion at which the liquid inlet portion 30 and the liquid outlet 93*a* of the liquid container 80 are coupled. The receiving portion 46 has a first portion 46*a* that has a plate shape and that extends in the X direction and the Y direction, a second portion 46*b* that has a plate shape and that is provided upright in the +Z direction from a −Y-direction end of the first portion 46*a*, and a third portion 46*c* that has a plate shape and that is provided upright in the +Z direction from a +Y-direction end of the first portion 46*a*. That is, the receiving portion 46 is provided in a shape that is convex in the −Z direction. An upper surface of the receiving portion 46, which includes a receiving surface R, is a recessed surface, and a lower surface that is opposite to the upper surface of the receiving portion 46 has a protruding surface shape that protrudes downward. Each of the first to third portions 46*a* to 46*c* protrudes, in the −X direction, more than an end surface 45*b* of the pressing portion 45 in the −X direction. In the pressing member 41, the receiving portion 46 is arranged such that the first portion 46*a* is positioned in the −Z direction with respect to the second insertion hole 45*h*.

A surface of the first portion 46*a*, which is positioned in the +Z direction, is defined as the receiving surface R. The receiving surface R is an inclined surface inclined in the −Z direction toward the +X direction. In other words, the receiving surface R is an inclined surface inclined in the direction of gravity as the distance from the liquid container 80 increases.

Figure 10:
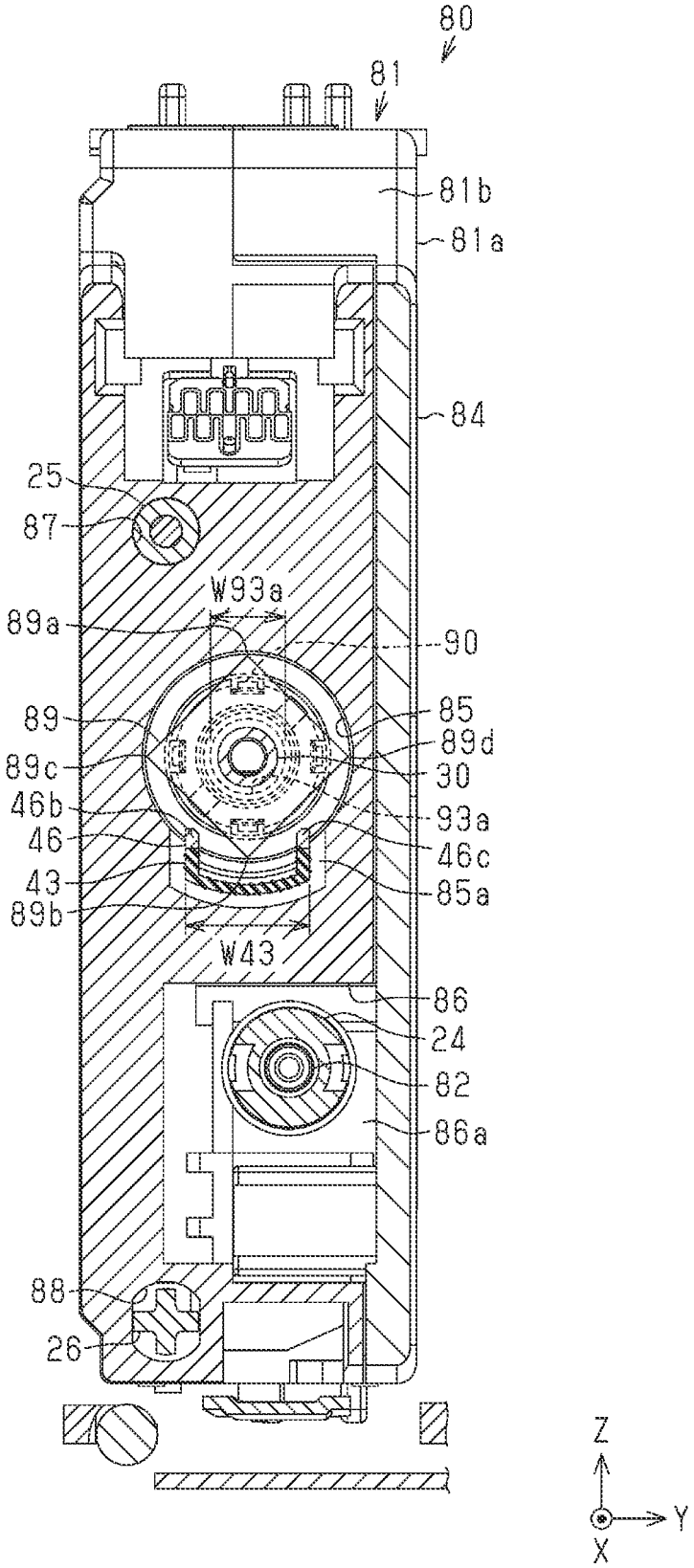
FIG. 10 is a portional view taken along line X-X in FIG. 4.

The elastic member 43 is provided in a −X-direction end of the receiving portion 46. The elastic member 43 is provided to extend over, in the −X-direction end of the receiving portion 46, the entire first portion 46*a*, a −Z-direction end of the second portion 46*b*, and a −Z-direction end of the third portion 46*c*. That is, the elastic member 43 is provided in a shape that is convex in the −Z direction. As illustrated in FIG. 10, a width of the elastic member 43 in the Y direction is defined as W43. Note that, in FIG. 10, a portion of the liquid container 80 other than the elastic member 43 is illustrated in cross portion along line X-X in FIG. 4, and a portion at which the elastic member 43 is positioned is illustrated in cross portion of the elastic member 43 along a plane orthogonal to the X-axis.

Here, since the elastic member 43 has the shape that protrudes in the −Z direction, an upper surface of the elastic member 43 is a recessed surface. Moreover, since the elastic member 43 has the shape that protrudes in the −Z direction, a lower surface of the elastic member 43, which is opposite to the upper surface, has a protruding surface shape that protrudes downward. Even when leaked liquid flows to below the elastic member 43, the leaked liquid flows along the lower surface of the elastic member 43 and flows downward from the vicinity of the widthwise center of the lower surface of the elastic member 43. The position at which downward flow occurs constitutes an anticipated path along which the leaked liquid is to pass. At a position in the −Z direction (lower side) with respect to the position of the widthwise center of the elastic member 43, a guiding path (not illustrated) that enables the liquid to be guided to a tray 62 (refer to FIG. 1) is provided.

As illustrated in FIG. 7, the pressing member 41 has first to third protruding portions 47 to 49 that protrude from the end surface 45*b* of the pressing portion 45 in the −X direction. The first protruding portion 47 is positioned in the +Z direction with respect to the receiving portion 46. The first protruding portion 47 has a portion positioned in the −Y direction with respect to the second insertion hole 45*h*, a portion positioned in the +Y direction with respect to the second insertion hole 45*h*, and a portion positioned in the +Z direction with respect to the second insertion hole 45*h*. That is, the first protruding portion 47 is provided so as to protrude in the +Z direction. The first protruding portion 47 has a first protrusion 47*a* and a second protrusion 47*b* that protrude from a −X-direction end surface of the first protruding portion 47. The second protruding portion 48 and the third protruding portion 49 have a substantially rectangular parallelepiped shape. The second protruding portion 48 and the third protruding portion 49 are arranged at the same height as the receiving portion 46 in the Z direction. The second protruding portion 48 and the first protrusion 47*a* are positioned in the −Y direction with respect to the receiving portion 46, and the third protruding portion 49 and the second protrusion 47*b* are positioned in the +Y direction with respect to the receiving portion 46. That is, the second protruding portion 48 and the third protruding portion 49 are positioned so as to hold the receiving portion 46 therebetween in the Y direction. The receiving portion 46 protrudes more than the first to third protruding portions 47 to 49 in the −X direction.

As illustrated in FIGS. 5, 6, 8, and 9, the pressing member 41 has a guiding portion 50. The guiding portion 50 guides liquid, which is received by the receiving portion 46, in the +X direction. That is, the guiding portion 50 guides the liquid, which is received by the receiving portion 46, in a direction away from the liquid container 80. The guiding portion 50 has a first channel forming portion 51 and a second channel forming portion 52.

The first channel forming portion 51 has first to fourth wall portions 51*a* to 51*d* that protrude from the main wall 45*a* in the +X direction. The first wall portion 51*a* and the second wall portion 51*b* are walls that extend in the X direction and the Z direction and that face each other in the Y direction. The first wall portion 51*a* is continuous to an end that is positioned in the −Y direction out of the two ends in the peripheral direction, which form the discontinuous portion 44*a* of the cover portion 44. The second wall portion 51*b* is positioned in the +Y direction with respect to the cover portion 44. The third wall portion 51*c* is a wall that is continuous to a −Z-direction end of the first wall portion 51*a*, and the fourth wall portion 51*d* is a wall that is continuous to a −Z-direction end of the second wall portion 51*b*. A +Y-direction end of the third wall portion 51*c* is continuous to a −Y-direction end of the fourth wall portion 51*d*. The −Z-direction end of the first wall portion 51*a* and the −Z-direction end of the second wall portion 51*b* are coupled in the Y direction by the third wall portion 51*c* and the fourth wall portion 51*d*.

Figure 8:
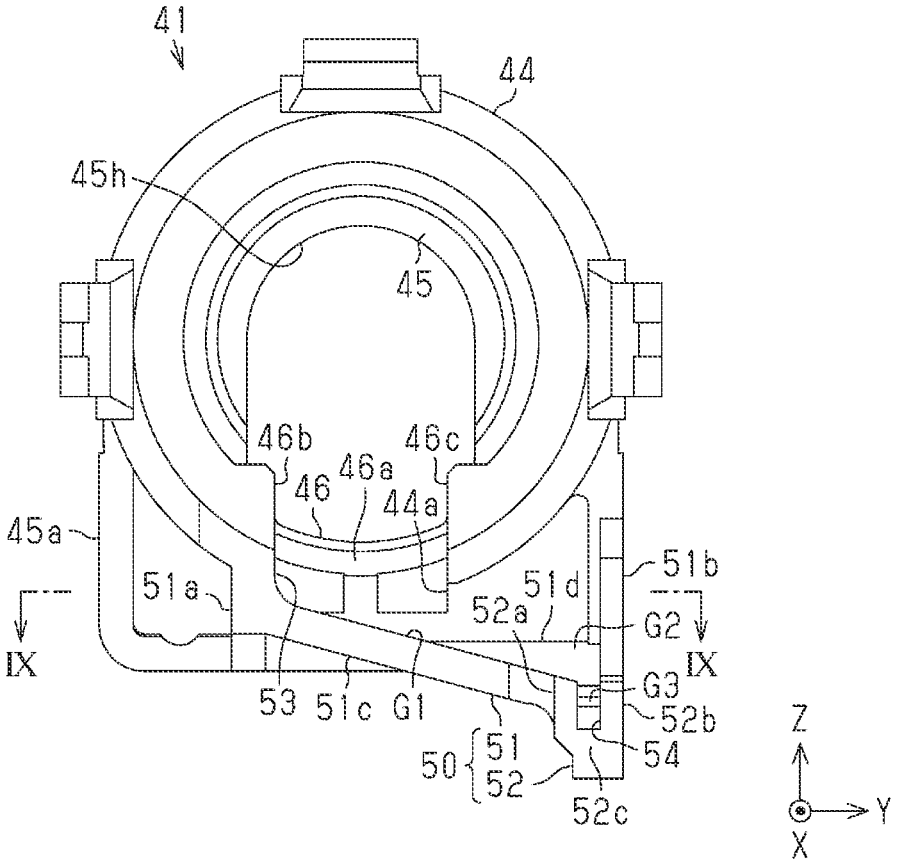
FIG. 8 is a side view of the pressing member.
Figure 9:
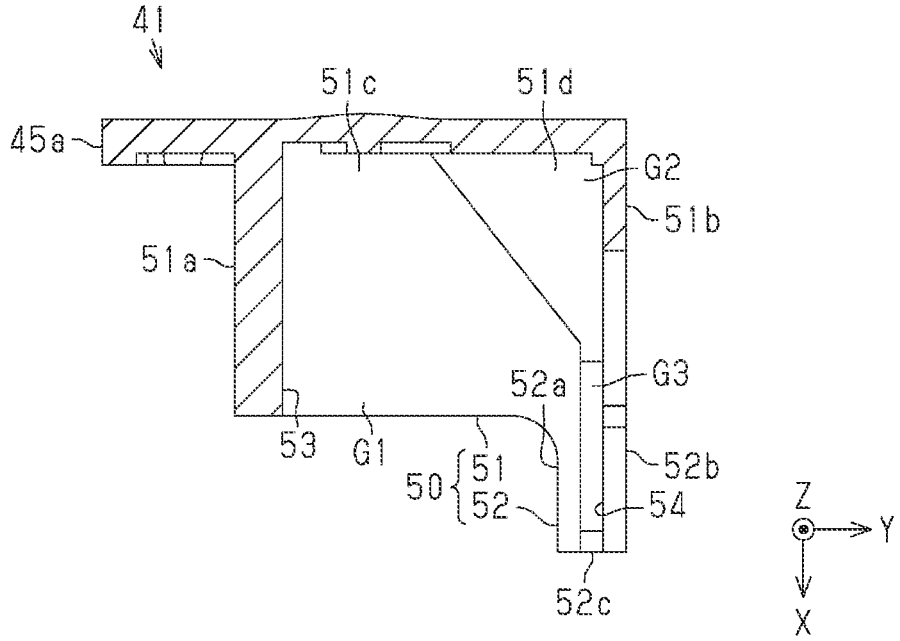
FIG. 9 is a portional view taken along line IX-IX in FIG. 8.

The third wall portion 51*c* has a first guiding surface G1 that is an end surface in the +Z direction. As illustrated in FIG. 9, when the pressing member 41 is viewed in the −Z direction, the first guiding surface G1 has a substantially trapezoidal shape. The first guiding surface G1 length in the X direction is fixed in a portion of the first guiding surface G1, which is positioned in the −Y direction with respect to the center in the Y direction, and decreases toward the +Y direction in a portion of the first guiding surface G1, which is positioned in the +Y direction with respect to the center in the Y direction. As illustrated in FIG. 8, the first guiding surface G1 is an inclined surface inclined in the −Z direction toward the +Y direction. Note that the first guiding surface G1 is not inclined in the X direction.

The fourth wall portion 51*d* has a second guiding surface G2 that is an end surface in the +Z direction. As illustrated in FIG. 9, when the pressing member 41 is viewed in the −Z direction, the second guiding surface G2 has a substantially triangular shape. The second guiding surface G2 length in the Y direction decreases toward the +X direction. That is, the second guiding surface G2 width in the Y direction decreases toward the +X direction. As illustrated in FIG. 8, the second guiding surface G2 is an inclined surface inclined in the −Z direction toward the +X direction. In other words, the second guiding surface G2 is the inclined surface inclined in the direction of gravity as the distance from the liquid container 80 increases. The second guiding surface G2 is also configured as an example of a narrow width portion whose width decreases as the distance from the liquid container 80 increases. Note that the second guiding surface G2 is not inclined in the Y direction.

The first channel forming portion 51 has a first guiding channel 53. The first guiding channel 53 is a space that is surrounded by a surface of the first wall portion 51*a* in the +Y direction, a surface of the second wall portion 51*b* in the −Y direction, the first guiding surface G1 of the third wall portion 51*c*, and the second guiding surface G2 of the fourth wall portion 51*d*.

The second channel forming portion 52 has first to third protruding pieces 52*a* to 52*c* that protrude from the first channel forming portion 51 in the +X direction. The first protruding piece 52*a* is continuous to the +Y-direction end of the third wall portion 51*c*. The second protruding piece 52*b* is continuous to the second wall portion 51*b*. The first protruding piece 52*a* and the second protruding piece 52*b* face each other in the Y direction. In the present embodiment, a gap between a surface of the first protruding piece 52*a* in the +Y direction and a surface of the second protruding piece 52*b* in the −Y direction is fixed in the X direction. The third protruding piece 52*c* is continuous to the fourth wall portion 51*d*. A −Z-direction end of the first protruding piece 52*a* and a −Z-direction end of the second protruding piece 52*b* are coupled in the Y direction by the third protruding piece 52*c*.

The third protruding piece 52*c* has a third guiding surface G3 that is an end surface in the +Z direction. As illustrated in FIG. 9, when the pressing member 41 is viewed in the −Z direction, the third guiding surface G3 has a rectangular shape. The third guiding surface G3 has a longitudinal direction in the X direction and the third guiding surface G3 has a transverse direction in the Y direction. The third guiding surface G3 is positioned in the −Z direction with respect to the second guiding surface G2. The third guiding surface G3 is an inclined surface inclined in the −Z direction toward the +X direction. In other words, the third guiding surface G3 is an inclined surface inclined in the direction of gravity as the distance from the liquid container 80 increases.

The second channel forming portion 52 has a second guiding channel 54. The second guiding channel 54 is a space that is surrounded by the surface of the first protruding piece 52*a* in the +Y direction, the surface of the second protruding piece 52*b* in the −Y direction, and the third guiding surface G3 of the third protruding piece 52*c*. The second guiding channel 54 communicates with the first guiding channel 53.

As illustrated in FIGS. 3 and 4, the cover portion 44 of the pressing member 41 and the urging member 42 are stored in the storage recess 23 of the first support portion 21. In such a state, the urging member 42 surrounds the liquid inlet portion 30, and the cover portion 44 of the pressing member 41 surrounds the urging member 42. The receiving portion 46 and the elastic member 43 are positioned in the −Z direction with respect to the liquid inlet portion 30. In other words, the urging mechanism 40 has the elastic member 43 disposed below the liquid inlet portion 30 in the direction of gravity. Moreover, the urging member 42 is positioned between the pressing portion 45 of the pressing member 41 and the bottom surface 23*a* of the storage recess 23 in the X direction.

A −X-direction end of the regulating portion 27 protrudes more than −X-direction ends of the first positioning protrusion 25 and the second positioning protrusion 26 in the −X direction. The −X-direction ends of the first positioning protrusion 25 and the second positioning protrusion 26 protrude more than the −X-direction end of the pressurizing portion 24 and the −X-direction end of the liquid inlet portion 30 in the −X direction. Moreover, the −X-direction end of the pressurizing portion 24 and the −X-direction end of the liquid inlet portion 30 protrude more than the elastic member 43 in the −X direction.

As illustrated in FIG. 1, the liquid ejecting apparatus 10 includes a guiding member 61 and the tray 62. The liquid ejecting apparatus 10 of the present embodiment includes five guiding members 61 corresponding to the five liquid inlet portions 30. The five guiding members 61 are arranged side by side in the Y direction. Each of the guiding members 61 guides, to the tray 62, the liquid received by the urging mechanism 40. The guiding members 61 are arranged between the attachment portion 15 and the tray 62 in the +X direction. A −X-direction end of each of the guiding members 61 is positioned in the −Z direction with respect to the second channel forming portion 52 of the attachment portion 15. A +X-direction end of each of the guiding members 61 is positioned in the +Z direction with respect to the tray 62.

The tray 62 is able to receive the liquid guided by the guiding member 61. That is, the tray 62 is able to receive the liquid received by the urging mechanism 40. The tray 62 includes a bottom wall 62*a* in a plate shape and a side wall 62*b* that is formed so as to be provided upright from a peripheral edge of the bottom wall 62*a*. Further, the tray 62 has a receiving area A1, in which liquid is received, and a detecting area A2, in which the received liquid is detected, in a surface of the bottom wall 62*a*, on which the side wall 62*b* is provided upright.

In the tray 62, the detecting area A2 is arranged in the +X direction with respect to the receiving area A1. The tray 62 is arranged so as to slope downward from the receiving area A1 toward the detecting area A2. That is, the surface of the bottom wall 62*a*, on which the side wall 62*b* is provided upright, is an inclined surface inclined in the −Z direction toward the +X direction.

In the receiving area A1, a plurality of grooves 63 recessed in the −Z direction from the surface of the bottom wall 62*a*, on which the side wall 62*b* is provided upright, are formed. The plurality of grooves 63 extend in a radial manner with the detecting area A2 as the center. Though not illustrated, a width of each of the grooves 63 decreases from the receiving area A1 toward the detecting area A2.

The liquid ejecting apparatus 10 includes an absorbing member 64 and a detecting portion 65. The absorbing member 64 and the detecting portion 65 are arranged in the detecting area A2. The absorbing member 64 and the detecting portion 65 are arranged side by side in the X direction. The detecting portion 65 is positioned in the +X direction with respect to the absorbing member 64. The absorbing member 64 is able to absorb the liquid received by the tray 62. That is, the absorbing member 64 is able to absorb the liquid received by the urging mechanism 40. The detecting portion 65 detects the liquid received by the tray 62. When detecting the liquid, the detecting portion 65 determines that liquid leakage occurs and transmits a signal to the control portion 18. When receiving, from the detecting portion 65, the signal indicating that the liquid leakage occurs, the control portion 18 stops supply of the pressurized fluid from the pressurizing mechanism 16 to the liquid container 80 to thereby avoid further leakage of the liquid.

Next, the liquid container 80 will be specifically described.

As illustrated in FIGS. 3 and 10, the liquid container 80 includes a case 81, a pressurized fluid inlet portion 82, a storage container 83, and a liquid outlet portion 90.

The case 81 has a rectangular parallelepiped shape that has a peripheral wall 81*a* which has a quadrangular cylindrical shape whose axis extends in the X direction, a first end wall 81*b* which is continuous to a +X-direction end of the peripheral wall 81*a*, and a second end wall (not illustrated) which is continuous to a −X-direction end of the peripheral wall 81*a*. As illustrated in FIG. 3, the case 81 has a first storage space 80*a* that is partitioned by an inner surface of the peripheral wall 81*a*, an inner surface of the first end wall 81*b*, and an inner surface of the second end wall. In an outer surface of a wall portion positioned in the −Z direction among wall portions that form the peripheral wall 81*a*, a regulating recess 81*d* is recessed.

The case 81 has a protruding portion 84 that has a block shape and that protrudes from an outer surface of the first end wall 81*b* in the +X direction. The protruding portion 84 has a tip end surface 84*a* as an end surface in the +X direction. The tip end surface 84*a* is a surface that extends in the Y direction and the Z direction. The tip end surface 84*a* is also an outer surface of the liquid container 80.

The protruding portion 84 has a first storage recess 85 and a second storage recess 86 that are recessed from the tip end surface 84*a* in the −X direction. The first storage recess 85 and the second storage recess 86 are formed side by side in the Z direction. The second storage recess 86 is positioned in the −Z direction with respect to the first storage recess 85. A second storage space 80*b* is formed inside the protruding portion 84. The second storage space 80*b* communicates with the first storage space 80*a*. In a bottom surface 85*a* of the first storage recess 85, a communication hole 85*h* by which the second storage space 80*b* and the first storage recess 85 interior communicate with each other is formed.

The pressurized fluid inlet portion 82 has a cylindrical shape that extends from a bottom surface 86*a* of the second storage recess 86 in the +X direction. The pressurized fluid inlet portion 82 causes the outside of the case 81 and the first storage space 80*a* to communicate with each other. In a state where the liquid container 80 is attached to the attachment portion 15, the pressuring portion 24 of the attachment portion 15 supplies the pressurized fluid into the first storage space 80*a* through the pressurized fluid inlet portion 82.

As illustrated in FIG. 10, the protruding portion 84 has a first positioning recess 87 and a second positioning recess 88 that are recessed from the tip end surface 84*a* in the −X direction. The first positioning recess 87 and the second positioning recess 88 are formed side by side in the Z direction. The first positioning recess 87 is positioned in the +Z direction with respect to the first storage recess 85. The second positioning recess 88 is positioned in the −Z direction with respect to the second storage recess 86.

As illustrated in FIG. 3, the storage container 83 stores liquid supplied to the liquid ejecting head 13. That is, the liquid container 80 stores the liquid supplied to the liquid ejecting head 13. The storage container 83 is formed into a bag shape by using a flexible material. The storage container 83 is stored in the first storage space 80*a* of the case 81. The liquid stored in the storage container 83 is led out to the attachment portion 15 by the liquid outlet portion 90.

The liquid outlet portion 90 has a first columnar portion 91 whose axis extends in the X direction, and a second columnar portion 92 that protrudes from an end surface of the first columnar portion 91 in the +X direction and that has an outer diameter smaller than that of the first columnar portion 91. The liquid outlet portion 90 has an outlet channel 93 that passes through the first columnar portion 91 and the second columnar portion 92 in the X direction. A −X-direction end of the first columnar portion 91 is coupled to the storage container 83. Therefore, the liquid stored in the storage container 83 is able to flow out to the outlet channel 93. The outlet channel 93 has the liquid outlet 93*a* that opens in an end surface of the second columnar portion 92 in the +X direction. As illustrated in FIG. 10, a width of the liquid outlet 93*a* in the Y direction is defined as W93*a*. The width W43 of the elastic member 43 in the Y direction is greater than the width W93*a* of the liquid outlet 93*a* in the Y direction.

As illustrated in FIG. 3, the first columnar portion 91 is stored in the second storage space 80*b*, and the second columnar portion 92 is inserted into the communication hole 85*h* and is stored in the first storage recess 85. The protruding portion 84 protrudes such that the tip end surface 84*a* is positioned in the +X direction with respect to the +X-direction end surface of the second columnar portion 92. Thus, the liquid outlet 93*a* opens in the first storage recess 85.

A valve portion 94 that is slidable in the X direction is provided inside the outlet channel 93. Further, a spring (not illustrated) that urges the valve portion 94 in the +X direction is provided inside the outlet channel 93. As illustrated in FIG. 3, in a state where the liquid container 80 is not attached to the attachment portion 15, when being urged by the spring, the valve portion 94 is arranged at a close position at which the valve portion 94 is positioned in a +X-direction end of the outlet channel 93. At this time, the outlet channel 93 does not communicate with the outside of the case 81. On the other hand, as illustrated in FIG. 4, in a state where the liquid container 80 is attached to the attachment portion 15, the liquid inlet portion 30 is inserted into the outlet channel 93, and thereby the valve portion 94 is pressed by the liquid inlet portion 30 and slides from the close position in the −X direction. Thereby, the valve portion 94 is arranged at an open position.

The liquid container 80 has a film 89 that covers the end surface of the second columnar portion 92 in the +X direction. That is, the liquid outlet 93*a* is covered by the film 89. The film 89 of the present embodiment is a square. As illustrated in FIG. 10, the film 89 is arranged such that a first corner 89*a* is positioned in the +Z direction, a second corner 89*b* that is positioned diagonally opposite the first corner 89*a* is positioned in the −Z direction, a third corner 89*c* is positioned in the −Y direction, and a fourth corner 89*d* that is positioned diagonally opposite the third corner 89*c* is positioned in the +Y direction.

As illustrated in FIG. 3, the liquid container 80 is arranged in the −X direction with respect to the attachment portion 15. At this time, the film 89 of the liquid container 80 faces the −X-direction end of the liquid inlet portion 30. A +X-direction end of the pressurized fluid inlet portion 82 faces the −X-direction end of the pressurizing portion 24. The first positioning recess 87 faces the first positioning protrusion 25. The second positioning recess 88 faces the second positioning protrusion 26.

For attaching the liquid container 80 to the attachment portion 15, the liquid container 80 is moved in the +X direction toward the attachment portion 15. Then, the regulating portion 27 is elastically deformed in the −Z direction such that the outer surface of the wall portion positioned in the −Z direction in the peripheral wall 81*a* slides with respect to the pin 27*a* of the regulating portion 27. As illustrated in FIG. 4, when the pin 27*a* is fitted into the regulating recess 81*d*, the regulating portion 27 elastically restores in the +Z direction. Thereby, movement of the liquid container 80 with respect to the attachment portion 15 in the −X direction is regulated. Further, the first positioning protrusion 25 is inserted into the first positioning recess 87 and the second positioning protrusion 26 is inserted into the second positioning recess 88. Thereby, the positioning of the liquid container 80 with respect to the attachment portion 15 in the Y direction and the Z direction is completed.

The liquid inlet portion 30 is coupled to the liquid outlet 93*a* of the liquid outlet portion 90. Specifically, a tip end of the liquid inlet portion 30 in the −X direction breaks through the film 89 of the liquid container 80 and then presses the valve portion 94, which is at the close position, in the −X direction. Thereby, the valve portion 94 at the close position slides in the −X direction and moves to the open position. A part of the liquid inlet portion 30 in the −X direction is inserted into the inlet channel 31. The outlet channel 93 and the inlet channel 31 communicate with each other through the communication hole 32.

At this time, the first protrusion 47*a* and the second protrusion 47*b* of the first protruding portion 47, the second protruding portion 48, and the third protruding portion 49 are in contact with the tip end surface 84*a* of the protruding portion 84, and the receiving portion 46 is inserted into the first storage recess 85. The first portion 46*a* of the receiving portion 46 is positioned in the −Z direction with respect to a portion at which the liquid outlet 93*a* and the liquid inlet portion 30 are coupled. The first portion 46*a* of the receiving portion 46 is also positioned in the −Z direction with respect to the second corner 89*b* of the film 89.

When the pressing member 41 is in contact with the liquid container 80, the pressing member 41 moves in the +X direction. The urging member 42 is compressed by the pressing portion 45 of the pressing member 41, which moves in the +X direction, and the bottom surface 23*a* of the storage recess 23. Therefore, the urging member 42 urges the pressing member 41 in the −X direction and the pressing member 41 urges the liquid container 80 in the −X direction. Further, when the urging member 42 urges the pressing member 41 in the −X direction, the receiving portion 46 is pressed against the bottom surface 85*a* of the first storage recess 85. Thereby, the elastic member 43 is crushed by the bottom surface 85*a* of the first storage recess 85 and the first portion 46*a* of the receiving portion 46 and is in close contact with the bottom surface 85*a* of the first storage recess 85. As illustrated in FIG. 10, both ends of the liquid outlet 93*a* in the Y direction are positioned within both ends of the elastic member 43 in the Y direction.

By bringing the first protrusion 47*a* and the second protrusion 47*b* of the first protruding portion 47, the second protruding portion 48, and the third protruding portion 49 into contact with the tip end surface 84*a* of the protruding portion 84, a compression amount of the elastic member 43 when the elastic member 43 hits the bottom surface 23*a* of the storage recess 23 is limited. As compared to the elastic member 43 in an original state, the elastic member 43 at this time is in a state of being compressed but not completely crushed. That is, when a compression amount of the elastic member 43 that is completely crushed is defined as CF, a compression amount C of the elastic member 43 is in a range of satisfying a condition of $0<C<CF$. For example, when the elastic member 43 is kept being completely crushed for a long period, the elastic member 43 is plastically deformed into a crushed state. In such a case, when the user attaches the liquid container 80 to the attachment portion 15 from the next time onward, there is concern that the crushed elastic member 43 is not able to be in close contact with the bottom surface 23*a* of the storage recess 23 and a gap is generated between the receiving portion 46 and the liquid container 80. On the other hand, the compression amount of the elastic member 43 of the present embodiment when the elastic member 43 hits the bottom surface 23*a* of the storage recess 23 is limited to be smaller than the compression amount CF of the elastic member 43 that is completely crushed, and therefore, the plastic deformation of the elastic member 43 into the crushed state is suppressed. Thus, the adhesive force when the elastic member 43 is in contact with the outer surface of the liquid container 80 is kept high for a long period.

The pressurizing portion 24 is coupled to the pressurized fluid inlet portion 82. As a result, the attachment of the liquid container 80 to the attachment portion 15 is completed.

When the liquid is introduced from the liquid outlet portion 90 of the liquid container 80 into the liquid inlet portion 30, the pressurizing mechanism 16 supplies the pressurized fluid to the liquid container 80. Specifically, by controlling operation of the pressurizing mechanism 16, the control portion 18 sends the pressurized fluid to a desired pressurizing portion 24 of the plurality of pressurizing portions 24. The pressurizing portion 24 supplies the pressurized fluid to the first storage space 80*a* by using the pressurized fluid inlet portion 82. Thereby, the storage container 83 stored in the first storage space 80*a* is pressed and the liquid inside the storage container 83 flows into the outlet channel 93, the communication hole 32, and the inlet channel 31 in this order. Then, the liquid introduced into the inlet channel 31 is supplied to the liquid ejecting head 13 thorough the coupling channel 17.

In when the liquid container 80 is detached from the attachment portion 15, for example, to exchange the liquid container 80, the liquid container 80 is moved in the −X direction. Thereby, the coupling of the liquid inlet portion 30 and the liquid outlet 93*a* and the coupling of the pressurizing portion 24 and the pressurized fluid inlet portion 82 are released. Specifically, the liquid inlet portion 30 is positioned outside the outlet channel 93, and thereby the inlet channel 31 and the outlet channel 93 do not communicate with each other. Further, by releasing the valve portion 94 in a state of being pressed by the liquid inlet portion 30, the valve portion 94 returns to the close position at which the valve portion 94 is positioned in the +X-direction end in the outlet channel 93. As a result, liquid leakage from the liquid outlet 93*a* is avoided.

The first positioning protrusion 25 is pulled out from the first positioning recess 87 and the second positioning protrusion 26 is pulled out from the second positioning recess 88. Further, when the regulating portion 27 is elastically deformed in the −Z direction, the pin 27*a* escapes from the regulating recess 81*d*. After that, the outer surface of the wall portion positioned in the −Z direction in the peripheral wall 81*a* of the case 81 slides with respect to the pin 27*a* of the regulating portion 27. When the peripheral wall 81*a* of the case 81 stops sliding with respect to the pin 27*a*, the regulating portion 27 elastically restores in the +Z direction. Thereby, the detachment of the liquid container 80 from the attachment portion 15 is completed.

Next, operation when liquid leaks from a portion at which the liquid outlet portion 90 and the liquid inlet portion 30 are coupled will be described.

The liquid that leaks from the portion at which the liquid outlet portion 90 and the liquid inlet portion 30 are coupled flows along the film 89 and flows downward from the second corner 89*b* of the film 89 onto the receiving surface R. That is, the receiving surface R of the receiving portion 46 receives the leaked liquid. Here, when no elastic member 43 is provided in the −Z direction with respect to the liquid inlet portion 30, a gap is generated between the liquid container 80 and the receiving portion 46 and the liquid received by the receiving portion 46 may leak from the gap. On the other hand, in the present embodiment, the elastic member 43 that is in close contact with the liquid container 80 is arranged in the −Z direction with respect to the liquid inlet portion 30. Therefore, the liquid that leaks from the portion at which the liquid outlet 93*a* and the liquid inlet portion 30 are coupled is stopped by the elastic member 43. That is, the leaked liquid is received by the receiving portion 46.

The receiving surface R of the present embodiment is the inclined surface inclined in the −Z direction toward the +X direction. Therefore, liquid received by the receiving surface R flows in the +X direction, that is, the direction away from the liquid container 80. In the +X direction with respect to the receiving surface R, the first guiding channel 53 is provided. Therefore, the liquid flowing along the receiving surface R is guided to the first guiding channel 53. Thus, the liquid received by the urging mechanism 40 flows in the first guiding channel 53. The first guiding channel 53 has the first guiding surface G1 that is inclined in the −Z direction toward the +Y direction and the second guiding surface G2 that is inclined in the −Z direction toward the +X direction. The liquid guided to the first guiding channel 53 is caused to flow in the +Y direction by the first guiding surface G1 and is then caused to flow in the +X direction, that is, the direction away from the liquid container 80 by the second guiding surface G2. In the +X direction with respect to the first guiding channel 53, the second guiding channel 54 is provided. Thus, the liquid flowing in the first guiding channel 53 is guided to the second guiding channel 54. Accordingly, the liquid received by the urging mechanism 40 flows in the second guiding channel 54. The second guiding channel 54 has the third guiding surface G3 that is inclined in the −Z direction toward the +X direction. The liquid guided to the second guiding channel 54 flows in the +X direction, that is, the direction away from the liquid container 80.

A +X-direction end of the second guiding channel 54 is positioned in the +Z direction with respect to the guiding member 61. Thus, the liquid flowing in the second guiding channel 54 flows downward onto the guiding member 61. The guiding member 61 receives the liquid that flows downward from the second guiding channel 54. The liquid received by the guiding member 61 flows in the +X direction due to capillary phenomenon and is thereby guided into the tray 62. In the receiving area A1 of the tray 62, the liquid guided by the guiding member 61 is received. The liquid received in the receiving area A1 is drawn into the groove 63 due to the capillary phenomenon. The bottom surface 62*a* is an inclined surface that slopes downward from the receiving area A1 to the detecting area A2. Thereby, the liquid drawn into the groove 63 due to the capillary phenomenon is guided to the detecting area A2 in a direction from the receiving area A1 to the detecting area A2 along the groove 63. The liquid guided to the detecting area A2 is absorbed by the absorbing member 64. The detecting portion 65 detects the liquid absorbed by the absorbing member 64. When receiving, from the detecting portion 65, a signal indicating the detection of the liquid, the control portion 18 stops supply of the pressurized fluid from the pressurizing mechanism 16 to the liquid container 80. As a result, leakage of the liquid does not spread.

Effects of the present embodiment will be described.

(1) The urging mechanism 40 has the elastic member 43 that is in close contact with the liquid container 80 and that is provided below the liquid inlet portion 30 in the direction of gravity. Therefore, when liquid leaks from the portion at which the liquid outlet 93*a* and the liquid inlet portion 30 are coupled, the leaked liquid is stopped by the elastic member 43. Accordingly, it is possible to suppress soiling in a wide range of an outer surface of the case 81 of the liquid container 80.

(2) The width W43 of the elastic member 43 in the Y direction is greater than the width W93*a* of the liquid outlet 93*a* in the Y direction and both the ends of the liquid outlet 93*a* in the Y direction are positioned within both the ends of the elastic member 43 in the Y direction. Accordingly, it is possible to suppress the leaked liquid flowing to below the elastic member 43.

(3) The elastic member 43 is provided in shape that is convex in the direction of gravity. Accordingly, it is possible to suppress the leaked liquid flowing to below the elastic member 43. Since the lower surface of the elastic member 43 has the protruding surface shape that protrudes downward, even when the leaked liquid flows to below the elastic member 43, the leaked liquid flows along the lower surface of the elastic member 43 and flows downward from the widthwise center position of the lower surface. The liquid that flows downward is guided to the tray 62 by passing through a guiding channel provided below the elastic member 43.

(4) The liquid outlet 93*a* opens in the first storage recess 85 in the tip end surface 84*a* of the protruding portion 84. In a state where the liquid container 80 is attached to the attachment portion 15, the elastic member 43 is in close contact with the bottom surface 85*a* of the first storage recess 85. Accordingly, it is possible to suppress the leaked liquid flowing along the outer surface of the case 81 of the liquid container 80. It is also possible to suppress a case where the user erroneously touches the liquid outlet 93*a* to exchange the liquid container 80. As result, the hand of the user is less likely to be soiled.

(5) The pressing member 41 has the first guiding channel 53 and the second guiding channel 54 as channels in which the liquid received by the urging mechanism 40 flows. The first guiding channel 53 has the second guiding surface G2 that is inclined in the direction of gravity as the distance from the liquid container 80 increases. The second guiding channel 54 has the third guiding surface G3 that is inclined in the direction of gravity as the distance from the liquid container 80 increases. The second guiding surface G2 and the third guiding surface G3 enable the leaked liquid to flow in the direction away from the liquid container 80.

(6) The first guiding channel 53 has the second guiding surface G2 as an example of the narrow width portion whose width decreases as the distance from the liquid container 80 increases. When the leaked liquid flows along the second guiding surface G2, the leaked liquid more easily flows in the direction away from the liquid container 80.

(7) The liquid ejecting apparatus 10 has the tray 62 that is able to receive the liquid received by the urging mechanism 40 and the detecting portion 65 that detects the liquid received by the tray 62. The detecting portion 65 is able to detect whether or not the liquid leaks from the portion at which the liquid outlet 93*a* and the liquid inlet portion 30 are coupled.

(8) The liquid ejecting apparatus 10 includes the absorbing member 64 that is able to receive the liquid received by the urging mechanism 40. The absorbing member 64 is able to absorb the leaked liquid.

The present embodiment is able to be modified and implemented as follows. The present embodiment and the modifications are able to be implemented in combination with each other within the scope they do not technically conflict.

The width W43 of the elastic member 43 in the Y direction may the same as the width W93*a* of the liquid outlet 93*a* in the Y direction. In this case, for example, both the ends of the liquid outlet 93*a* in the Y direction may be at the same positions as those of both the ends of the elastic member 43 in the Y direction.

The width W43 of the elastic member 43 in the Y direction may be smaller than the width W93*a* of the liquid outlet 93*a* in the Y direction. In this case, for example, both the ends of the liquid outlet 93*a* in the Y direction may be positioned outside both the ends of the elastic member 43 in the Y direction.

The receiving portion 46 may have a V-shape that protrudes in the −Z direction. In this case, the elastic member 43 may have a V-shape that protrudes in the −Z direction in accordance with the shape of the receiving portion 46.

The receiving portion 46 may not have the shape that protrudes in the −Z direction. For example, the receiving portion 46 may have only the first portion 46*a*.

The elastic member 43 may not have the shape that protrudes in the −Z direction. For example, the elastic member 43 may have a shape that linearly extends in the Y direction.

The receiving surface R of the receiving portion 46 may be a flat surface whose height in the Z direction is fixed in the X direction.

The end surface of the second columnar portion 92 of the liquid outlet portion 90 in the +X direction may protrude more than the tip end surface 84*a* of the protruding portion 84. In this case, the liquid outlet 93*a* opens outside the first storage recess 85.

The pressing member 41 may not have the guiding portion 50.

A configuration of the guiding portion 50 may be appropriately modified.

As an example, the guiding portion 50 may have only the first channel forming portion 51.

As another example, the second channel forming portion 52 may be formed such that the gap between the surface of the first protruding piece 52*a* in the +Y direction and the surface of the second protruding piece 52*b* in the −Y direction decreases toward the +X direction. In this case, the second guiding channel 54 width in the Y direction decreases toward the +X direction. In other words, the second guiding channel 54 has the narrow width portion whose width in the Y direction decreases as the distance from the liquid container 80 increases. With the narrow width portion, the leaked liquid more easily flows in the direction away from the liquid container 80.

In the bottom surface 85*a* of the first storage recess 85, a groove that is recessed in the −X direction or a rib that protrudes in the +X direction may be provided. A plurality of grooves or a plurality of ribs that extend from the liquid outlet 93*a* to the elastic member 43 are provided in the Y direction. In this case, with a gap between the grooves or a gap between the ribs, the leaked liquid is easily guided to the elastic member 43 and the receiving portion 46.

The surface of the receiving portion 46, on which the elastic member 43 hits the liquid container 80 when the liquid container 80 is attached to the attachment portion 15, is not limited to the bottom surface 85*a* of the first storage recess 85 and may be the tip end surface 84*a* that is positioned below the first storage recess 85. In this case, a groove that is recessed in the −X direction or a rib that protrudes in the +X direction may be provided in a region of the tip end surface 84*a*, which is above the elastic member 43 when the elastic member 43 hits the liquid container 80. In this case, with a gap between grooves or a gap between ribs, the leaked liquid is easily guided to the elastic member 43 and the receiving portion 46.

The guiding member 61 may not be provided. In this case, for example, by arranging the tray 62 in the −Z direction with respect to a +X-direction end of the second channel forming portion 52, the liquid that flows out from the second guiding channel 54 is directly received by the tray 62.

The tray 62, the absorbing member 64, and the detecting portion 65 may be separately provided.

For example, the tray 62 may be arranged in the −Z direction with respect to a +X-direction end of the guiding member 61 and an exit through which the liquid is able to flow out may be provided in a +X-direction end of the tray 62. The absorbing member 64 is arranged in the +X direction with respect to the exit of the tray 62. In this case, the liquid received by the tray 62 flows outside the tray 62 through the exit and is then absorbed by the absorbing member 64. The detecting portion 65 may be provided in the tray 62, may be arranged between the exit of the tray 62 and the absorbing member 64, or may be arranged in a state of being in contact with the absorbing member 64.

The tray 62 and the detecting portion 65 may not be provided. In this case, by arranging the absorbing member 64 in the −Z direction with respect to the +X-direction end of the guiding member 61, the liquid guided by the guiding member 61 is absorbed by the absorbing member 64.

Technical ideas that can be understood from the aforementioned embodiment and the modifications, and operation effects thereof will be described below.

(A) A liquid ejecting apparatus includes: a liquid ejecting head configured to eject liquid; and an attachment portion to which a liquid container that stores the liquid supplied to the liquid ejecting head is detachably attached, in which the attachment portion includes a liquid inlet portion that is coupled to a liquid outlet provided in the liquid container, and an urging mechanism that urges the liquid container in a direction opposite to an attaching direction in which the liquid container is attached to the attachment portion, and the urging mechanism includes an elastic member that is in close contact with the liquid container attached to the attachment portion and that is provided below the liquid inlet portion in a direction of gravity.

According to such a configuration, when the liquid leaks from a portion at which the liquid outlet and the liquid inlet portion are coupled, the leaked liquid is stopped by the elastic member. Accordingly, it is possible to suppress soiling in a wide range of an outer surface of the liquid container.

(B) In the liquid ejecting apparatus, in a direction intersecting the attaching direction and the direction of gravity, a width of the elastic member may be greater than a width of the liquid outlet, and both ends of the liquid outlet may be positioned inside both ends of the elastic member.

According to such a configuration, it is possible to suppress the leaked liquid flowing to below the elastic member.

(C) In the liquid ejecting apparatus, the elastic member may be provided in a shape that is convex in the direction of gravity.

According to such a configuration, it is possible to suppress the leaked liquid flowing to below the elastic member.

(D) In the liquid ejecting apparatus, the liquid outlet may open in a recess in an outer surface of the liquid container, and in a state where the liquid container is attached to the attachment portion, the elastic member may be in close contact with a bottom surface of the recess.

According to such a configuration, it is possible to suppress the leaked liquid flowing along the outer surface of the liquid container. It is also possible to suppress a case where a user erroneously touches the liquid outlet to exchange the liquid container. As result, a hand of the user is less likely to be soiled.

(E) In the liquid ejecting apparatus, the urging mechanism may include a pressing member that is integrated with the elastic member, the pressing member may include a channel in which the liquid received by the urging mechanism flows, and the channel may include an inclined surface inclined in the direction of gravity as a distance from the liquid container increases.

According to such a configuration, it is possible to cause the leaked liquid to flow in a direction away from the liquid container.

(F) In the liquid ejecting apparatus, the channel may include a narrow width portion whose width decreases as the distance from the liquid container increases.

According to such a configuration, the leaked liquid easily flows in the direction away from the liquid container.

(G) The liquid ejecting apparatus may further include: a tray configured to receive the liquid received by the urging mechanism; and a detecting portion that detects the liquid received by the tray.

According to such a configuration, it is possible to detect whether or not liquid leaks.

(H) The liquid ejecting apparatus may further include an absorbing member configured to absorb the liquid received by the urging mechanism.

According to such a configuration, the absorbing member is able to absorb the leaked liquid.

What is claimed is:

1. A liquid ejecting apparatus comprising:

a liquid ejecting head configured to eject liquid; and an attachment portion to which a liquid container, that stores the liquid supplied to the liquid ejecting head, is detachably attached, wherein the attachment portion includes a liquid inlet portion that is coupled to a liquid outlet provided in the liquid container, and an urging mechanism that urges the liquid container in a direction opposite to an attaching direction in which the liquid container is attached to the attachment portion, the urging mechanism includes an elastic member that is in close contact with the liquid container attached to the attachment portion and that is provided below the liquid inlet portion in a direction of gravity, and an upper surface of the elastic member is a recessed surface.

2. The liquid ejecting apparatus according to claim 1, wherein in a direction intersecting the attaching direction and the direction of gravity, a width of the elastic member is greater than a width of the liquid outlet, and both ends of the liquid outlet are positioned inside both ends of the elastic member.

3. The liquid ejecting apparatus according to claim 1, wherein the elastic member is provided in a shape that is convex in the direction of gravity, a lower surface of the elastic member has a protruding surface shape that protrudes in the direction of gravity, and the lower surface of the elastic member is opposite to the upper surface of the elastic member.

4. The liquid ejecting apparatus according to claim 1, wherein the liquid outlet opens in a recess in an outer surface of the liquid container, and in a state where the liquid container is attached to the attachment portion, the elastic member is in close contact with a bottom surface of the recess.

5. The liquid ejecting apparatus according to claim 1, wherein the urging mechanism includes a pressing member that is integrated with the elastic member, the pressing member includes a channel in which leaked liquid flows, the leaked liquid is leaked from a portion at which the liquid outlet and the liquid inlet portion are coupled, and the channel includes an inclined surface inclined in the direction of gravity as a distance from the liquid container increases.

6. The liquid ejecting apparatus according to claim 5, wherein the channel includes a narrow width portion whose width decreases as the distance from the liquid container increases.

7. The liquid ejecting apparatus according to claim 1, further comprising:

a tray configured to receive the liquid received by the urging mechanism; and a detecting portion that detects the liquid received by the tray.

8. The liquid ejecting apparatus according to claim 1, further comprising an absorbing member configured to absorb the liquid received by the urging mechanism.

9. The liquid ejecting apparatus according to claim 1, further comprising a pressing member integrated with the elastic member, wherein the pressing member includes a channel in which the liquid flows, and the channel includes a narrow width portion whose width decreases as a distance from the liquid container increases.

* * * * *